US006299081B1

(12) United States Patent
Strasser et al.

(10) Patent No.: US 6,299,081 B1
(45) Date of Patent: Oct. 9, 2001

(54) TUBE MILL

(75) Inventors: Siegfried Strasser, Much; Albert Süsseger, Eitorf; Franz Göddecke, Leverkusen; Alexander Hagedorn, Pulheim, all of (DE)

(73) Assignee: KHD Humboldt Wedag AG (DE)

( * ) Notice: Subject to any disclaimer, the term of this patent is extended or adjusted under 35 U.S.C. 154(b) by 0 days.

(21) Appl. No.: 09/521,846

(22) Filed: Mar. 9, 2000

(30) Foreign Application Priority Data

Mar. 30, 1999 (DE) ..... 199 14 288

(51) Int. Cl.[7] ..... B02C 17/00
(52) U.S. Cl. ..... 241/54
(58) Field of Search ..... 241/54, 68

(56) References Cited

U.S. PATENT DOCUMENTS 3,537,658 * 11/1970 Jurgenjanich ..... 241/54
3,712,549 * 1/1973 Cleemann ..... 241/54

FOREIGN PATENT DOCUMENTS 0184326 1/1989 (EP) .

* cited by examiner

*Primary Examiner*—Lowell A. Larson
(74) *Attorney, Agent, or Firm*—Sonnenschein Nath & Rosenthal

(57) ABSTRACT

To construct a tube mill such that a simple and compact circulation grinding system can be created therewith, with little outlay in terms of machinery, that can also manage higher stock circulation rates without high operating costs, a tube mill is disclosed whose drop-delivery housing consists of two spaced stationary non-rotating side faces, between which a rotatably mounted material conveyor ring is arranged, which can be rotated; whereby a sifting space with a dynamic sifter and/or a static sifter is integrated in this so constructed drop-delivery housing.

20 Claims, 2 Drawing Sheets

TUBE MILL

BACKGROUND OF THE INVENTION

The invention relates to a tube mill having a rotatably mounted milling tube with a grinding stock input end and a ground stock delivery end that is housed by a drop-delivery housing for delivering the ground stock and the mill gas.

Tube mills serve for crushing, or respectively, grinding, stock, which is usually transported in the rotary milling tube from the grinding stock input end to the ground stock delivery end using a mill air, or respectively, a drying gas, and is usually milled with the aid of grinding elements such as steel balls located in the mill tube, for which reason one speaks of air-swept mills, ball mills, and so on. It is known (EP-B-0184326) to arrange a delivery cone at the ground stock delivery end of a tube mill, which comprises openings that are distributed about the perimeter for delivering the ground stock and the mill gas. There, the delivery openings for the ground stock and the mill gas are housed by a stationary drop-delivery housing, in which the ground drops down, is delivered out below, and is transported to a downstream sifter, usually by a bucket elevator, whereas the mill gas, which is laden with finest grain, is drawn up out of the stationary product drop-delivery housing and likewise conducted to a sifter. The oversized material (grit) separated out by the sifter is re-circulated to the grinding stock input end of the tube mill. The tube mill and the at least one external sifter that has been necessary heretofore thus form a circulation milling system, whose construction, together with the necessary conveyor mechanisms such as bucket elevators and so on, requires relatively high outlay.

SUMMARY OF THE INVENTION

The invention is based on the object of designing a tube mill such that a simple and compact circulation milling system can be created therewith, given a low outlay terms of machinery, which system is capable of managing higher stock circulation rates without high operating costs.

What is characteristic of the inventive tube mill is that its drop-delivery housing is not a stationary, completely immobile component; rather, the drop-delivery housing consists of two spaced, stationary, non-rotating side faces between which a material conveyor ring is arranged, which is rotatably mounted and can be rotated by means of a rotary drive. This rotating material conveyor ring of the drop-delivery housing that surrounds the delivery opening for the ground stock and the mill gas rotates at, for instance, approximately 40–80% of the critical r.p.m.; that is, the material conveyor ring carries at least part of the mill's delivered stock to before or beyond the upper vertex of the ring and allows this stock material to drop; and namely, into an integrated sifting space formed in the intermediate space between the at least one ground stock delivery opening of the mill tube and the rotating material conveyor ring between the two stationary side faces of the drop-delivery housing. It would also be possible to have the material conveyor ring rotate more rapidly, and to strip the ground material from the inner wall of the ring using strippers.

For the sifting space that is integrated in the rotating material conveyor ring to function, it stands in connection with a sifting air inlet opening, to a delivery opening for sifting air and sifted fine material, and to a delivery opening for sifted oversized material in at least one of the two side faces. The space-consuming bucket elevators or other conveyance mechanisms for transporting the delivered stock of the mill to the integrated sifter are forgone, as is at least one external sifter that has always been required heretofore.

In the integrated sifting space of the drop-delivery housing with the rotating material conveyor ring, at least one rod basket of a dynamic sifter can be arranged, whereby the axis of the rod basket is situated parallel to the mill tube axis. The feeding of the mill's delivered stock to the integrated sifter, which can be a static and/or dynamic sifter, is accomplished in part by the rotating material conveyor ring and in part by the milling air and/or the sifting air. As a rule, the quantity of milling air is less than the quantity of sifting air that is required for sifting the mill's delivered stock, so that environmental air is usually drawn into the integrated sifting space to support the sifting. In the mill-drying of wet stocks, a hot gas flow can also be used for sifting.

The oversized stock of the sifter that is collected in the integrated sifting space, which is collected, or respectively, is separated from the sifting airflow, at the periphery of the at least one rotating rod basket in a dynamic sifter, is re-circulated to the grinding stock input of the tube mill via a conveyance mechanism, particularly an air conveyor trough, so that a compact circulation grinding system is realized.

A line for venting the sifting air, which is laden with fine material, runs from the sifting space integrated in the drop-delivery housing through an opening in at least one of the two side faces of the drop-delivery housing, said line leading to a separator for separating out the fine material from the sifting air.

BRIEF DESCRIPTION OF THE DRAWINGS

The invention and its additional features and advantages are detailed with the aid of the schematically illustrated exemplifying embodiment. Shown are.

DETAILED DESCRIPTION OF THE PREFERRED EMBODIMENTS

Figure 1:
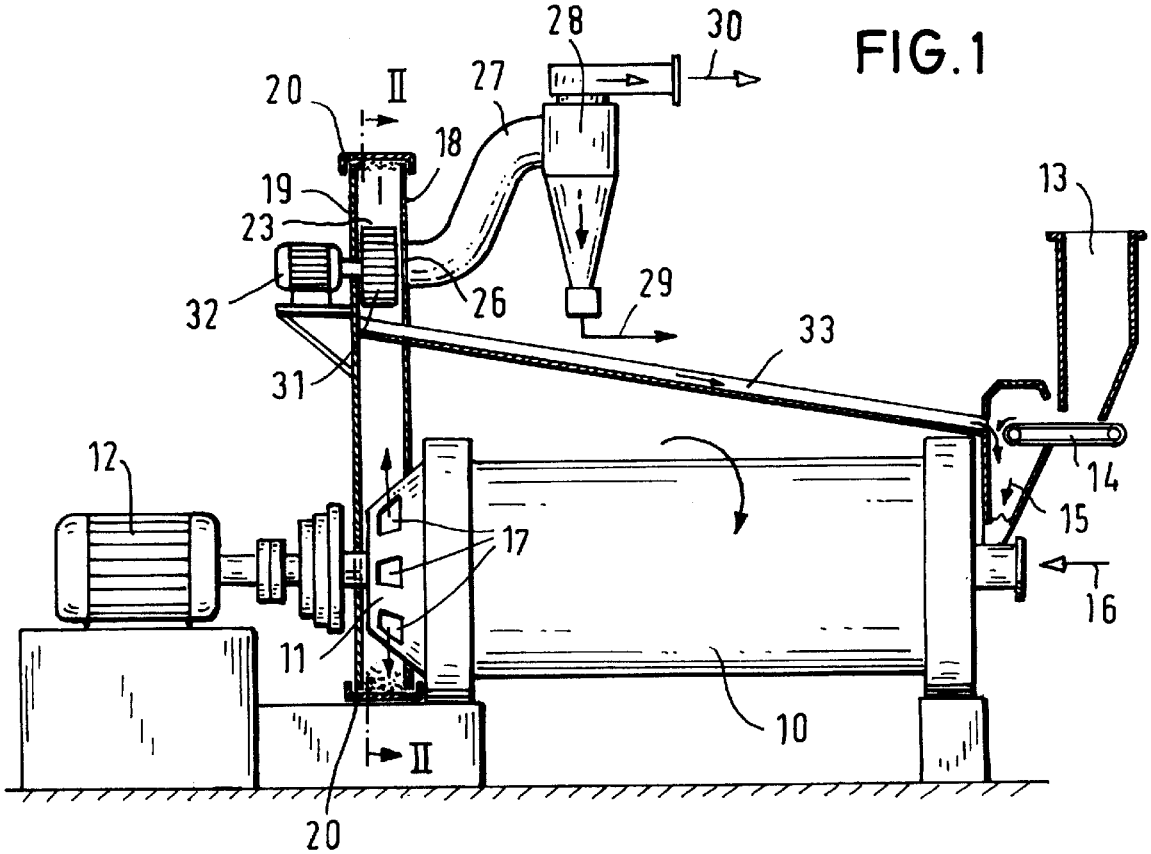
FIG. 1 is a side view, partly in a vertical section, of the inventive tube mill system with an integrated sifter, configured into a circulation grinding system.

The tube mill of FIG. 1 comprises a rotatably mounted milling tube 10 with a grinding stock input end on the night side and a ground stock delivery end on the left side. At the delivery end, the milling tube 10 is connected to a delivery cone 11, via which the tube mill is driven by a motor 12. The grinding stock is guided from the supply bunker 13 into the mill tube 10, which is filled with grinding bodies such as balls, via a metering apparatus 14 and an intake chute 15. Milling air 16 is also drawn in to the mill tube 10 at the input end. In the mill-drying of wet stock, a hot gas flow can also be used as milling air 16. Several openings 17 for delivering the ground stock and the milling air are arranged so as to be distributed about the perimeter of the mill delivery cone 11.

The delivery cone 11 with its delivery openings 17 for ground stock and milling air is surrounded by a drop-delivery housing, which inventively consists of two spaced stationary non-rotating side faces 18 and 19, between which a rotatably mounted, rotatable material conveyor ring 20 is arranged, which ring terminates the drop-delivery housing exteriorly at the periphery of the side faces 18,19. The material conveyor ring 20 can be rotated on rollers 21 and 22, and the rotation of the material conveyor ring 20 is accomplished via its cylindrical shell; for instance, by means of the driven bearing roller 22 or some other drive mechanism engaging the conveyer ring. The ground stock that has been delivered from the delivery openings 17 of the tube mill drops onto the inner wall of the rotating material conveyor ring 20, which wall may be provided with lift elements, as warranted; whereby, the rotation rate of the ring 20 lies below what is known as the critical rate; that is, the ring 20 carries the ground stock into the region of the upper vertex of the ring and lets this stock material drop, specifically into a sifting space 23 that is arranged above the delivery cone 11 in the drop-delivery housing, the housing of which space is formed by the two side faces 18, 19. As illustrated in the exemplifying embodiment of FIG. 1, the material conveyor ring 20 can surround the edges of the two spaced side faces 18, 19 at its two sides; however, the two edges of the ring 20 can also be arranged within the two spaced side faces 18,19.

Figure 2:
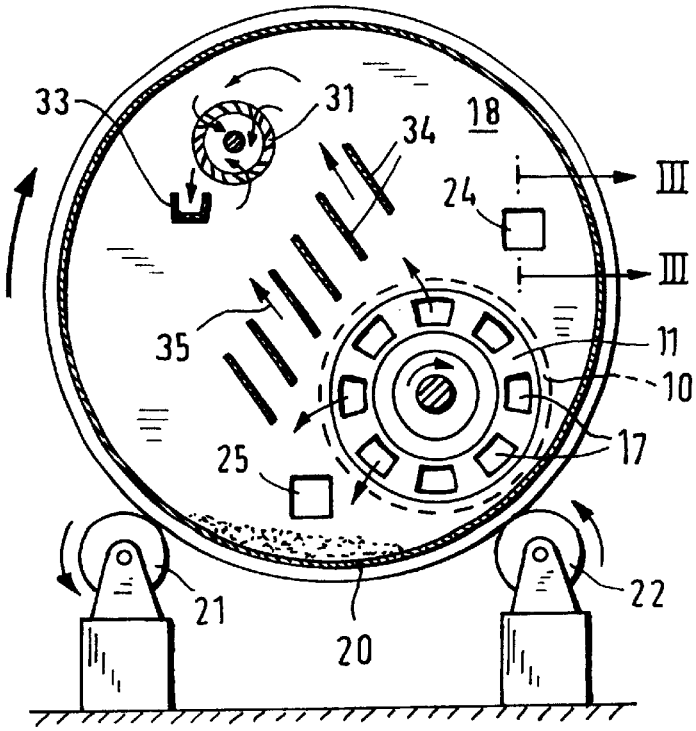
FIG. 2 is a cross-section along the line II—II of FIG. 1.
Figure 3:
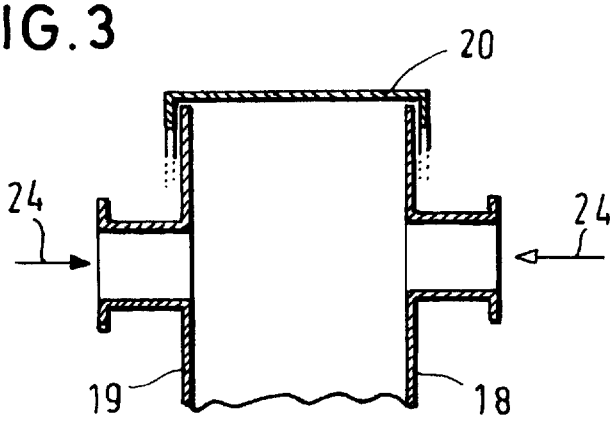
FIG. 3 is a detailed cross-section along the line III—III of FIG. 2.

As emerges from FIGS. 2 and 3, sifting air intake openings 24, 25 and a delivery opening 26 for sifting air and sifted fine material (FIG. 1) are arranged in at least one of the two side faces 18, 19 of the drop-delivery housing, from which latter opening a line 27 for venting the sifting air that is laden with sifted fine material runs, said line leading to a separator 28 for separating the fine material 29 from the sifting air 30, which is vented by an induced draft ventilator (not illustrated).

According to the exemplifying embodiment, at least one rod basket 31 of a dynamic sifter is arranged in the sifting space 23 of the drop-delivery housing, whereby the rod basket axis is situated parallel to the milling tube axis. The sifted oversized material that collects on the periphery of the rotating rod basket 31 (which is driven by the rod basket drive motor 32) is re-circulated to the grinding stock input of the tube mill via a conveyance element 33, particularly an aerial conveyor trough for grit.

From the sectional illustration of FIG. 2, it is evident from the arrows drawn there that the mill tube 10 and the material conveyor ring 20 of the drop-delivery housing can turn in the same direction. Different directions would also be possible, however. The sectional illustration in FIG. 2 further shows that plate type baffles 34 for guiding the sifted-air/ground-fine-material flow 35 are arranged in the drop-delivery housing in the flow path from the ground stock delivery openings 17 of the tube mill to the rotor of the rod basket sifter 31.

Figure 4:
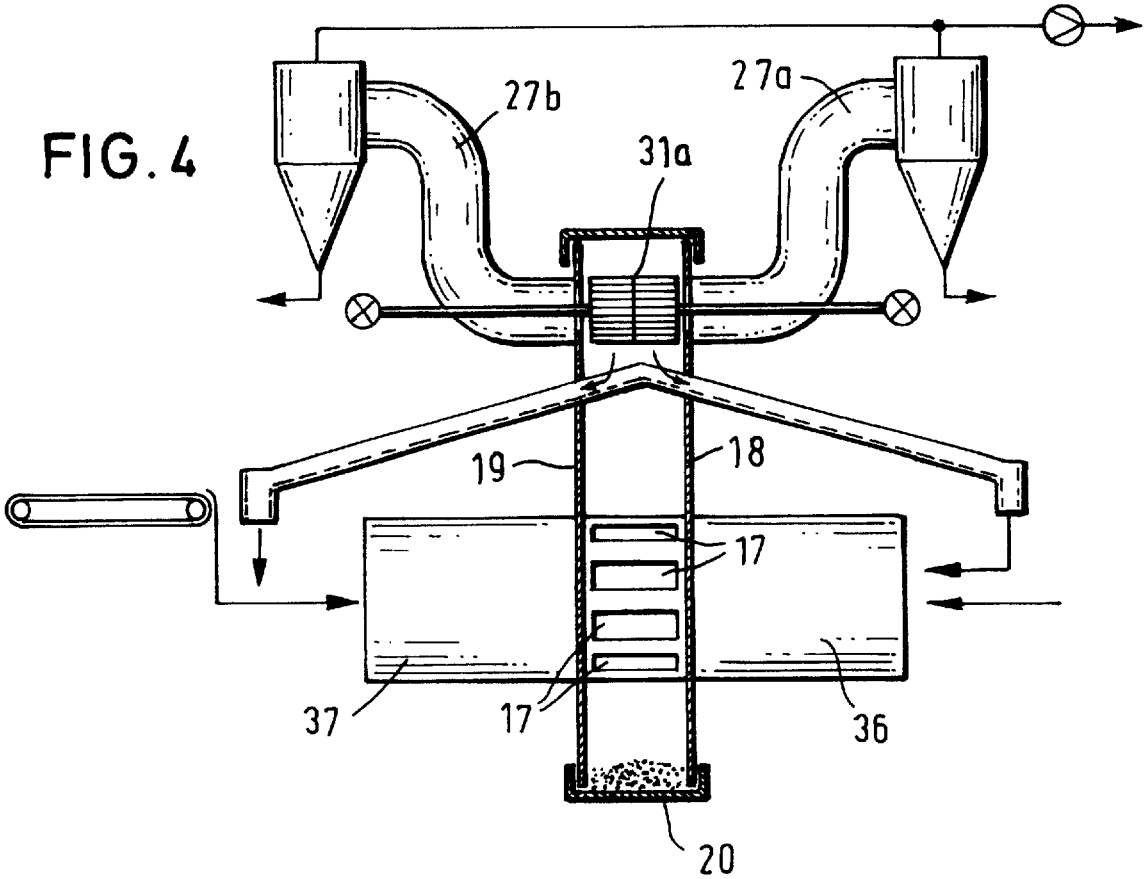
FIG. 4 is the invention as applied in what is known as a two-chamber tube mill with central delivery.

FIG. 4 shows that the invention can also be used in a two-chamber tube mill with central delivery. In this two-chamber mill the ground stock delivery openings 17 of the drop-delivery housing, which surrounds the two grinding chambers 36, 37 and which is likewise composed of the two spaced stationary non-rotating side faces 18,19 and the rotatable material conveyor ring 20, are arranged in the central longitudinal region. In the sifting space of the drop-delivery housing of the two-chamber mill, at least one sifter rod basket 31*a* is arranged, at whose two rotor ends (in a dual realization) a stream 27*a*, 27*b* of sifting air which is laden with sifted fine material is respectively vented, whereby the sifted oversized material that has collected on the periphery of the two halves of the rod basket is re-circulated to the grinding stock input of the one grinding chamber 36, on one hand, and to the grinding stock input of the other grinding chamber 37, on the other hand.

The invention can be applied not only in tube mills with a central drive, but also in tube mills with other drives, for instance toothed ring drives.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

We claim as our invention:

1. A tube mill having a rotatably mounted mill tube with a grinding stock input end with at least one inlet opening and a ground stock delivery end with at least one outlet opening for discharging fine material and oversized material comprising:

a drop-delivery housing comprising at least two spaced apart stationary side faces and a conveyor ring extending between said side faces to enclose an intermediate space forming a sifting space, said conveyor ring rotatably mounted relative to said side faces, a drive mechanism engaging said conveyor ring to rotate it relative to said side faces, said mill tube extending into said intermediate space through one of said side faces such that said outlet opening in said grinding stock delivery end is positioned within said intermediate space, a sifting air intake opening extending through at least one of said side faces into said intermediate space, a delivery exit opening for sifting air and sifted fine material in at least one of said two side faces from said intermediate space, and a delivery exit opening for sifted oversized material in at least one of said two side faces from said intermediate space.

2. A tube mill according to claim 1, wherein said conveyor ring is rotated at 40% to 80% of the critical rate of rotation such that said conveyor ring carries at least part of said fine and oversized material to before or beyond an upper vertex of said ring and lets said material drop into said intermediate space.

3. A tube mill according to claim 2, wherein said conveyor ring has an inner wall provided with lift elements which carry said material up toward said upper vertex of said ring.

4. A tube mill according to claim 2, wherein said rotating conveyor ring delivers said oversized material to said sifting space and said sifting air delivers said fine material to said sifting space.

5. A tube mill according to claim 1, wherein said conveyor ring is rotated at a super critical rate of rotation and at least one stripper element is positioned to engage an inner wall of said conveyor ring to strip said material from said ring near an upper vertex of said ring.

6. A tube mill according to claim 1, wherein said drive mechanism for said conveyor ring comprises at least one driven bearing roller.

7. A tube mill according to claim 1, including at least one rod basket of a dynamic sifter arranged within said sifting space.

8. A tube mill according to claim 7, wherein said rod basket having an axis of rotation which is parallel to an axis of rotation of said mill tube.

9. A tube mill according to claim 7, wherein said rod basket having an axis of rotation which arranged at an angle to an axis of rotation of said mill tube.

10. A tube mill according to claim 7, wherein sifted oversized material that has collected on a periphery of said rotating rod basket of said integrated rod basket sifter is re-circulated to said grinding stock input of said tube mill via a conveyor element.

11. A tube mill according to claim 10, wherein said conveyor element comprises particularly an aerial conveyor trough for grit.

12. A tube mill according to claim 7, wherein said rod basket is driven by a drive mechanism which projects through one side face of said drop-delivery housing.

13. A tube mill according to claim 12, wherein the other side face of said drop-delivery housing has an opening which is situated opposite ane end of said rod basket that is on the drive side, from which opening a line for venting said sifting air, said line leading to a separator for separating fine material from sifted air.

14. A tube mill tube according to claim 1, including plate type baffles for guiding the sifting-air ground-fine-material flow arranged in said drop-delivery housing on a path from said at least one ground stock delivery opening of the tube mill to a sifter.

15. A tube mill comprising a two-chambered rotatably mounted mill tube with a grinding stock input for both chambers comprising at least one inlet opening arranged at each end of said tube and a ground stock delivery outlet opening located centrally along said tube for discharging fine material and oversized material comprising:

a drop-delivery housing comprising at least two spaced apart stationary side faces and a conveyor ring extending between said side faces to enclose an intermediate space forming a sifting space, said conveyor ring rotatably mounted relative to said side faces, a drive mechanism engaging said conveyor ring to rotate it relative to said side faces, said mill tube extending through said intermediate space through said two side faces such that said ground stock delivery outlet opening is positioned within said intermediate space, at least one sifting air intake opening for said drop-delivery housing extending through at least one of said side faces into said intermediate space, at least one delivery exit opening for said drop-delivery housing for sifting air and sifted fine material in at least one of said two side faces from said intermediate space, and at least one delivery exit opening for said drop-delivery housing for sifted oversized material in at least one of said two side faces from said intermediate space.

16. A tube mill according to claim 15, including at least one rod basket of a dynamic sifter arranged within said sifting space.

17. A tube mill according to claim 16, including two co-axial rod baskets wherein an axis of rotation of each of said baskets is parallel to an axis of rotation of said mill tube.

18. A tube mill according to claim 17, wherein sifted oversized material collects on a periphery of said rotating rod baskets and including a first conveyor element for recirculating said collected oversized material to one of said glinding stock inputs for said tube mill and a second conveyor element for recirculating said collected oversized material to the other of said grinding stock inputs.

19. A tube mill according to claim 18, wherein said conveyor elements each comprise an aerial conveyor trough for grit.

20. A tube mill according to claim 17, wherein said rod baskets are driven by drive mechanisms which extends through opposite side faces and said at least one outlet opening for sifting air laden with fine material comprises two openings, each surrounding a portion of one of said drive mechanisms.

* * * * *